United States Patent [19]

Sarver

[11] Patent Number: 4,600,337

[45] Date of Patent: Jul. 15, 1986

[54] BOARD MAT SYSTEM

[76] Inventor: Ronald D. Sarver, P.O. Box 51333, Lafayette, La. 70505

[21] Appl. No.: 546,907

[22] Filed: Oct. 31, 1983

[51] Int. Cl.[4] ..... E01C 5/14

[52] U.S. Cl. ..... 404/35; 404/41; 404/46; 52/536; 52/538

[58] Field of Search ..... 404/35, 36, 41, 46; 52/536, 538

[56] References Cited

U.S. PATENT DOCUMENTS

| | | | |
|---|---|---|---|
| 1,935,823 | 11/1933 | Turner | 404/46 |
| 2,652,753 | 9/1953 | Smith | 404/41 |
| 2,819,026 | 1/1958 | Leyendecker | 404/41 X |
| 2,912,909 | 11/1959 | Hart | 404/36 |
| 3,254,576 | 6/1966 | Metelka | 404/35 |
| 3,626,651 | 12/1971 | Kough et al. | 52/536 |
| 3,765,783 | 10/1973 | Wager | 404/2 |
| 3,875,714 | 4/1975 | Nayler et al. | 52/538 X |
| 4,289,420 | 9/1981 | Davis et al. | 404/35 |
| 4,376,596 | 3/1983 | Green | 404/35 |
| 4,462,712 | 7/1984 | Penland Sr. | 404/46 X |

FOREIGN PATENT DOCUMENTS

| | | | |
|---|---|---|---|
| 295492 | 8/1928 | United Kingdom | 404/41 |

*Primary Examiner*—James A. Leppink
*Assistant Examiner*—Matthew Smith
*Attorney, Agent, or Firm*—Keaty & Keaty

[57] ABSTRACT

A system of prefabricated board mats for assembling plank roads for supporting heavy equipment on unprepared surfaces. The system is based on a standard eight foot by sixteen foot three-ply treated lumber prefabricated board road section. Individual board mat sections are linked in the direction of travel using a mating male and female plug and socket system to evenly transfer the weight load of heavy equipment in the direction of travel. Angle iron interlocks are provided laterally at the corners. The mats are lifted by use of three or more eyebolts countersunk into the top of the mat at strategic locations so that balance is maintained.

In practice a porous protector filter cloth section is laid on an area where a board mat is to be placed. The individual board mat sections are laid successively from an initial prepared position by rolling out the protective cloth, lifting the individual sections by crane or the like, dropping the section into position, linking them transversely through the lateral connections. The installation machinery and the supply truck containing the individual board mat sections then proceed forward onto the section of boards laid and install a second section. Each successive section is longitudinally linked by installing a male plug end into an exposed female end which is at the outer edge as the normal laying process proceeds. This direction facilitates successive installation by machinery of the board mats.

15 Claims, 7 Drawing Figures

FIG. 1
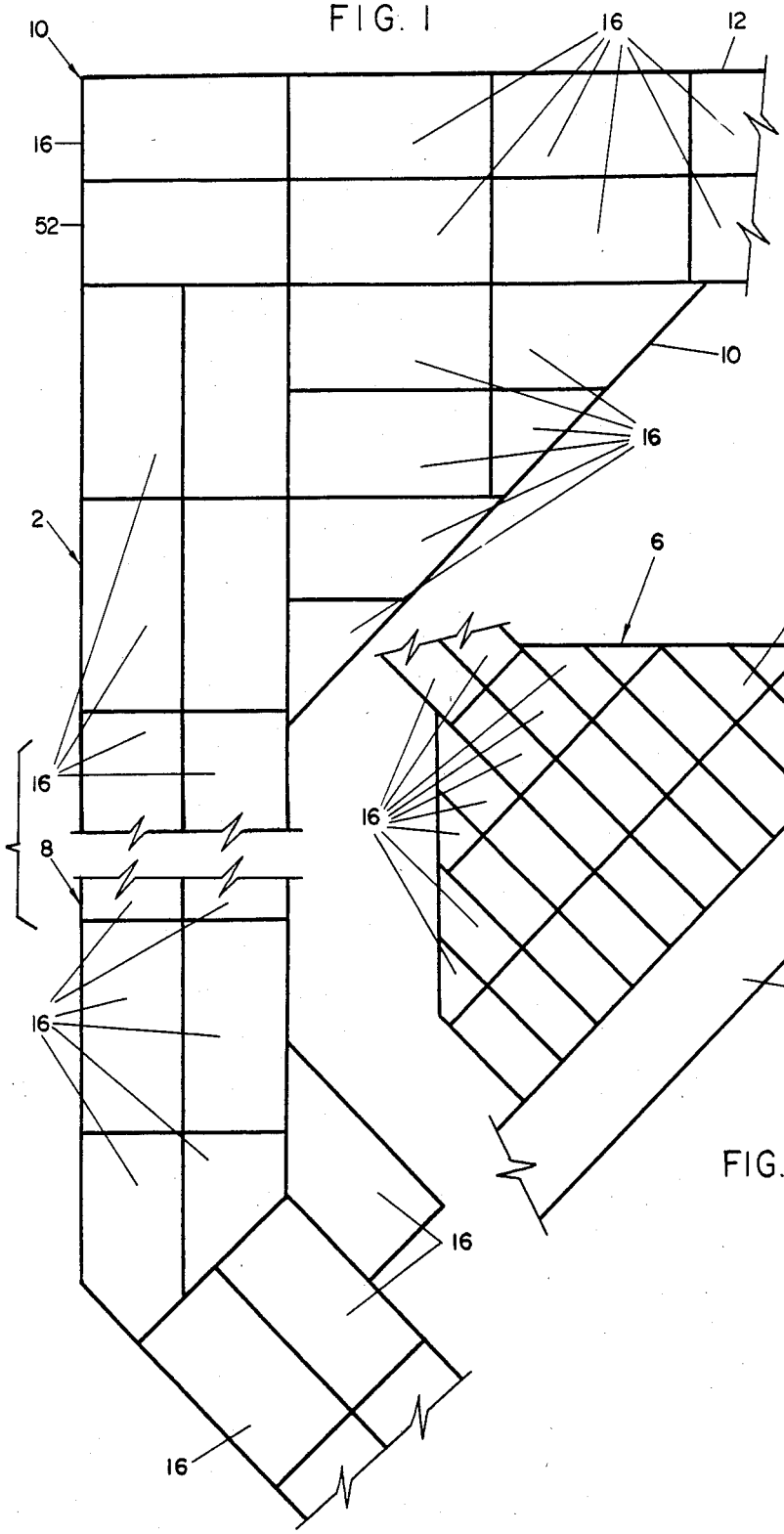
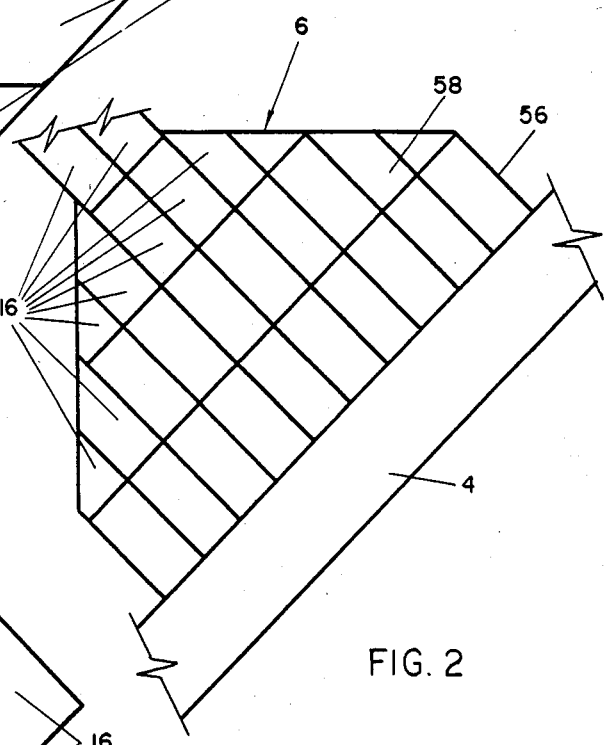
FIG. 2

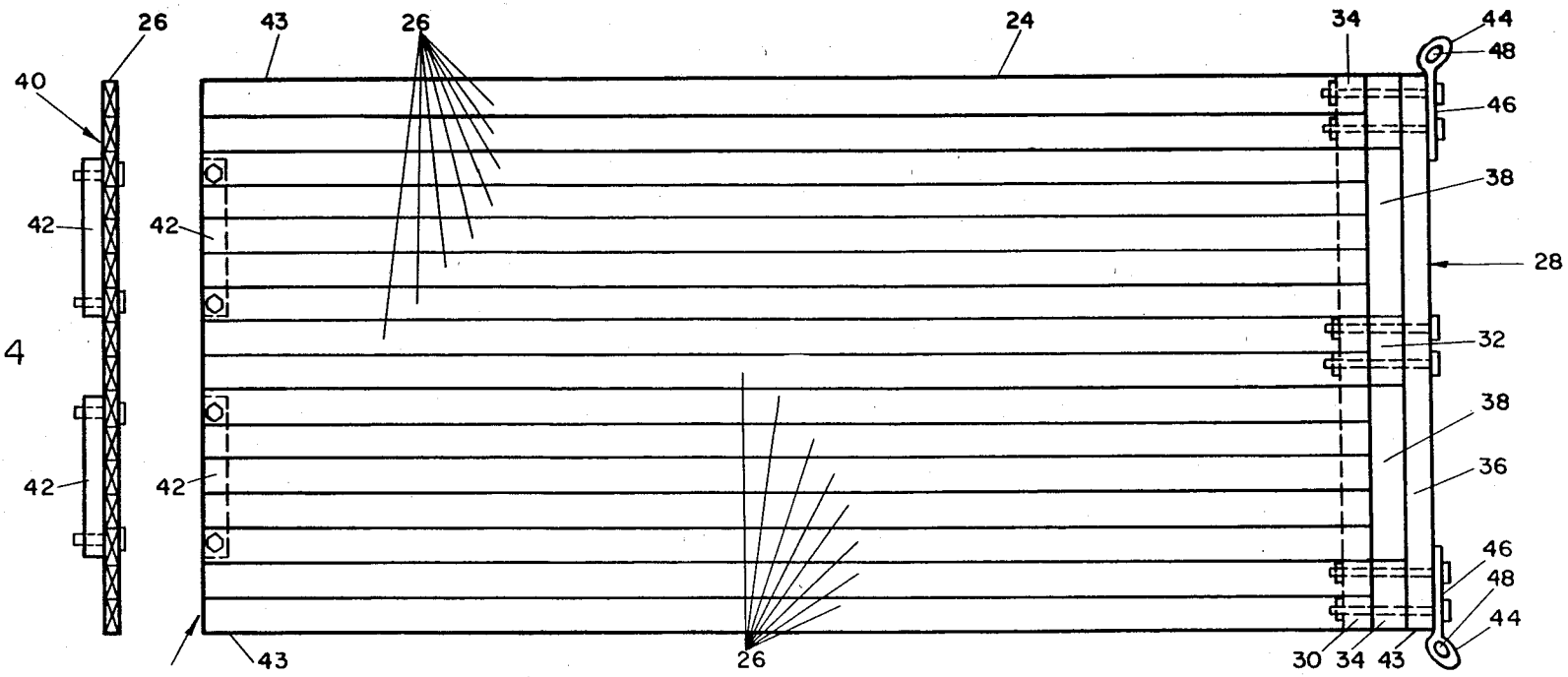
FIG. 3
FIG. 4
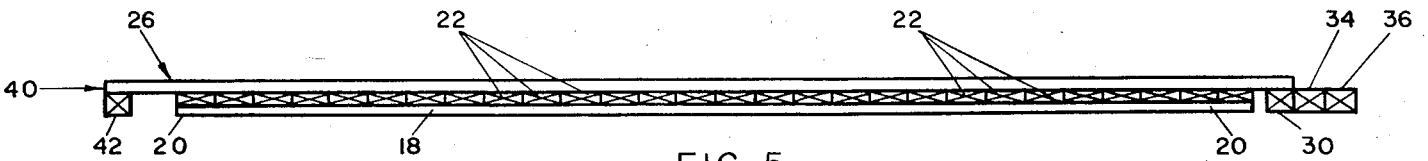
FIG. 5

24
42
38
40
28
16
54
52

BOARD MAT SYSTEM

BACKGROUND OF THE INVENTION

This invention relates to an apparatus and method for building board or plank roads in undeveloped area over unprepared road beds for use by heavy trucks and machinery. It is customary in the oilfield industry to have the requirement of transporting heavy machinery on trucks to remote areas in fields and the like where there is no prepared roadbed. The axle loading of a typical heavy equipment truck is such that it is not feasible to drive it across a scraped or unprepared ground surface without experiencing sinking, jamming of the truck, and similar impediments.

It has therefore become customary to provide temporary roads to a wellsite in the oilfield industry by means of a plank road. The typical method for laying the plank road is as follows:

First, a path is made from an existing prepared road to the desired wellsite by means of a bulldozer. This path primarily consists of breaking down and pushing aside undergrowth and similar impediments. There is no preparation of an underbed or support surface drainage. Ditches may or may not be dug, depending upon the water level and the water table at the site concerned.

An impervious, waterproof layer is laid on the roadway. As will be shown, this layer must prevent sinking of the board road components, it is therefore usually a heavy plastic sheet such as Visquene TM, vinyl, polyethelyne, or the like. The remainder of the road is constructed on the flotation layer.

The board road is constructed by laying a first layer lengthwise to the direction of travel. This first layer uses boards commonly referred to as 3×8's, although there is no such formal size of wood. Hardwood is provided for strength and durability; the cost of prepared hardwood lumber results in the use of the cheapest, roughest cut hardwood lumber available commercially. The length average fourteen feet but neither the length nor the size of this lumber is repeatable. The boards are usually warped. They are selected for cheapness of price because they are used for approximately two years and then discarded. The first layer is simply laid loose upon the ground.

A second layer is laid crosswise to this first layer. It is assembled closely spaced together, utilizes the same basic size of lumber and is tacked to the lower layer using six inch spikes or sixty penny nails.

The actual truck traffic is supported on a third board run layer. This board run layer comprises two longitudinal strips of boards each four feet wide. There is a four foot gap between the two strips. This produces in total the twelve foot industrially standard plank road. This layer is densely tacked using four nails approximately three feet apart per board.

The above description is general; individual contractors will vary but the overall technique remains the same.

The average board road is run for a distance of several hundred feet including a turnaround at the wellhead. In the turnaround, as in any turn area, the third layer of planks is laid as a continuous cover rather than as tracks.

Because of the cost of the lumber involved in the road, it is necessary to disassemble and salvage as much as possible after completion of the construction of the plank road and completion of the work at the wellhead.

This removal involves ripping up the individual boards concerned, salvaging those that are not too badly damaged by this process and reusing them.

The typical plank road requires a team of fifteen men working for five to ten days to assemble; it requires a similar sized team for a similar period of time to salvage. The weight of the equipment and trucks that use the board road require the use of hardwoods in order to obtain a suitable support strength. The expense of the hardwoods is such that they must be salvaged. This expense is also the reason for using the cheapest grade available of the hardwoods concerned. Nonetheless, the average hardwood plank lasts less than two years in this service and then new planks must be obtained.

SUMMARY OF THE INVENTION

The invention comprises a system of prefabricated board mat sections for constructing a plank road. These sections may be prefabricated in a shop; the prefabrication may be automated. The materials used generally tend to be on hand and are more easily worked in a shop.

The advantages of using a small number of easily handled prefabricated sections to build a board road is most evident in field usage. Board roads using the invention are very fast to install. Whereas the prior art technique requires approximately fifteen people for approximately five to ten days to install a typical board road, the same road can be installed using only a two to three person team.

Board roads using these particular mats must be installed on a filter cloth whereas the prior board roads, having a loose underlayer, are usually installed on an impervious Visquene TM or similar heavy duty plastic film base which was destroyed through use and required replacement. The flotation capability of the individual sections permits their use in areas where the individual board roads of the old technique were totally impractical due to the tendency of the individual first layer boards to sink out of sight. In addition, the ability to use a porous cloth rather than a Visquene TM underburden provides water drainage and dryness and eliminates a major problem of rotting that occurs in older styled plank roads.

This fact is very important to the extended life of the mats which is one of the major advantages of the invention. As an additional benefit to using the filter cloth, it makes clean up work quicker, easier, and better. Also it is expected that a large percentage of the filter cloth may be salvaged if desired for use on other sites. In some cases where a more permanent road will replace the board road, the filter cloth may be left to provide a better base for the aggregate road.

The individual sections are designed around a typical 8′×16′ long section. A unique transition section is used to create turn and angles. Further the use of the 8′×16′ sections permits a 16′ wide plank road to be built in lieu of the current 12′ wide standard plank road which required extreme operator skill to maneuver large equipment. The 12′ road standard was developed as a compromise between the minimum width necessary to operate large equipment and the extensive manpower and material costs required to build an old style plank road. With the new system it requires little or no more effort to achieve a 16′ width as it does to achieve a 12′ width.

Using a prefabricated mat allows you to more permanently bind the material together. This means very few or no loose boards. The conventional system allows that eventually the boards must be dismantled and the permanence of the fabrication can sometimes be questioned. Many of loose or broken boards have gone through the floors of cars or broken transmissions or caused flat tires. The boardmat system will greatly reduce or eliminate this.

The individual board sections or mats are normally in the shape of an 8'×16' rectangle. To maneuver these boardmats into position, a three point sling is installed to attaching eyebolts. When the mat is installed the pin through the locking pin holes on the angle iron serves to lock together in a transverse direction two or more of the boardmats. The boardmats have at their narrow ends respectively a male double plug and a female double socket mating section. This particular connection is in the direction of intended travel along the road; that is the boardmats are laid lengthwise in the direction of intended travel. A special mat having a similar male plug locking attachment along both of its sides is provided so that turns may be assembled for turnouts and angles. The long side having the adapted male plugs is installed along a plurality of narrow female mating sides of extending board mats providing a 90° transition in the direction of travel of the board road.

The use of the board mats also permits taking up the board road by easily pulling out the individual mats by a crane as the mats are linked solely by pins to the angle irons and by the socket and plug connections. It is only necessary to pull the pins, attach the crane to the individual mat and lift. The mats can be stacked for shipment, moved to a new location and reused.

The 8'×16' dimension of the mat allows for easy shipment on a flatbed truck which is also 8' wide. By stacking the material on top of each other in two stacks on a 40' long bed, it is possible to transport over twice as much material at one time than conventional broad road material.

It is thus an object of this invention to provide a prefabricated mat capable of being used to assemble a board road for use by heavy equipment and trucks and the like.

It is the further object of this invention to provide a prefabricated mat for use in assembling board roads which has an extended lifetime.

It is a further object of this invention to provide a prefabricated section or mat for assembling board roads which is capable of withstanding the heavy truck traffic encountered in the oilfield industry and the like.

It is a further object of this invention to provide a series of prefabricated mat sections which may be used to assemble a board road and which may be readily disassembled and retained in a usable configuration after use in a board road thus permitting the assembly of temporary roads in minimum time and at minimum material and labor cost.

These and other advantages of the instant invention will be more apparent from the detailed description of the preferred embodiment of the invention below:

DETAILED DESCRIPTION OF THE DRAWINGS

FIG. 1 is a top view of a section of board road assembled using the invention.

FIG. 2 is a top view of a board road turn out assembled using the invention.

FIG. 3 is a typical board mat in top view.

FIG. 4 is an end view of a board mat male end.

FIG. 5 is a side view of a board mat.

DETAILED DESCRIPTION OF THE PREFERRED EMBODIMENT

Figures 6, 7:
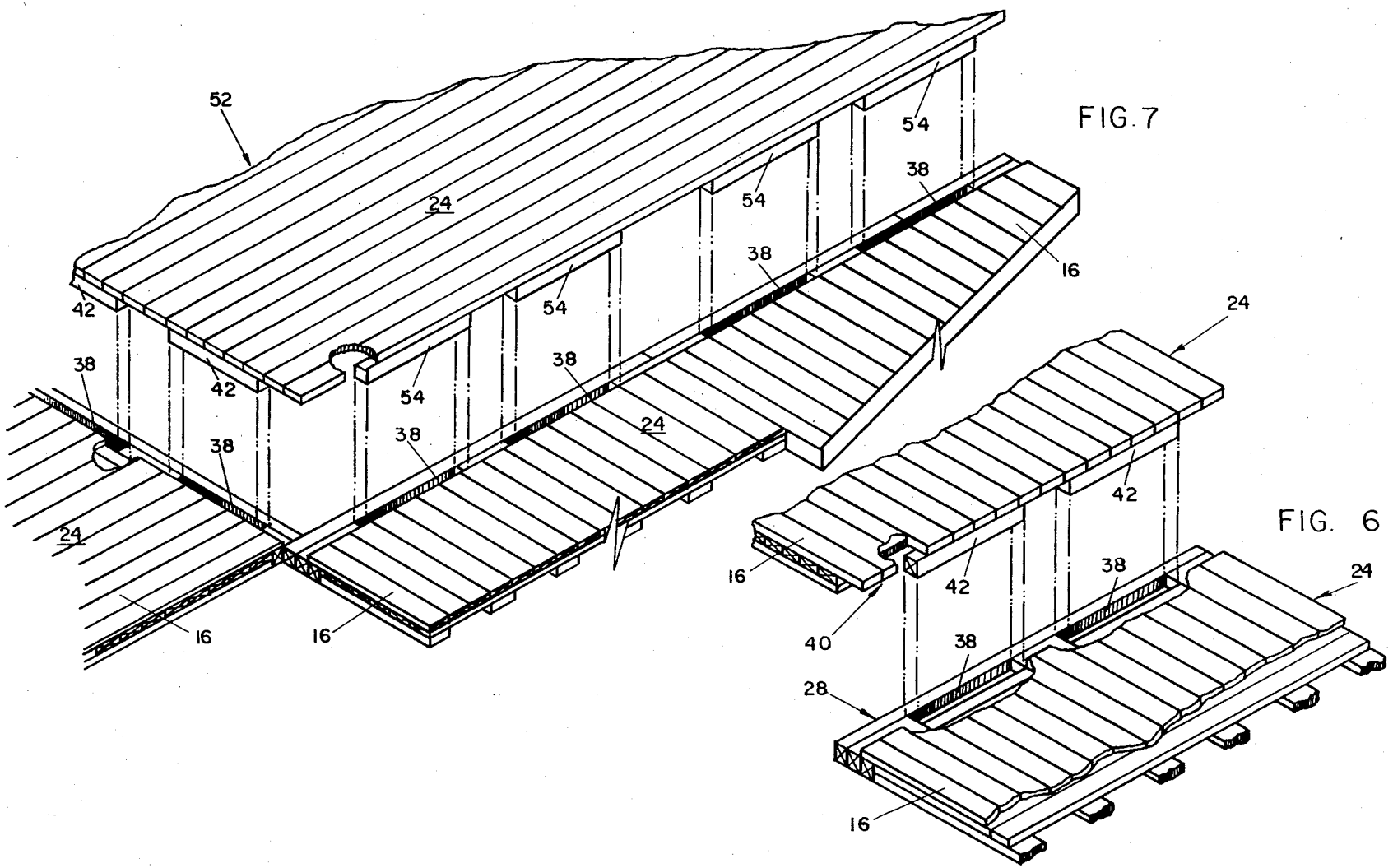
FIG. 6 is a detail view of the male-female mating end of a board mat.
FIG. 7 is a detail view of the mating of an alternate form of the board mat.

Turning now to FIGS. 1 and 2, a board road 2 is shown in section view comprised of succeeding sections of a first board mat 16 or a second board mat 52, hereinafter described in more detail.

In general, such roads are constructed starting from an existing paved main highway 4 by constructing a wide turnoff junction 6, typically sixty feet wide by sixty feet long, tapering to parallel eight-foot sections of board mat 16, forming thereby a first road path 8 which road path is typically sixteen feet long or the width of two board mats 16.

Turns are constructed in general by a form of a turn junction 10 constructed by interlocking board mat sections 16 and a second board mat section 52 in a manner to be hereinafter described providing thereby a wider path allowing for the turning of a vehicle proceeding down the board road 2.

Such a junction 10 in turn tapers into a second road path 12 and this process continues until the final widening at a well head mat, not shown.

Thus the board road 2 is constructed from a selection of a limited number of standard board mats 16, 52.

Turning to FIG. 3, I show the first standard mat 16 which comprises a driving area in the preferred embodiment eight feet wide and sixteen feet long. It is constructed of a series of lengthwise base boards 18 which may either be closely spaced or spaced apart up to approximately eight inches apart in one embodiment of the invention. Said base boards 18 are continuous board planks running longitudinally the length of the first board mat 16. The ends 20 of the base boards 18 are cut somewhat shorter than the overall sixteen-foot length of the first board mat 16 for reasons that will be hereinafter explained.

Tightly nailed or screwed or otherwise affixed to the base boards 18 are a plurality of mid-cross boards 22 which are firmly affixed, tightly continuous sideways abutting to one another, running at right angles to the base boards 18. The length of each such mid-cross board 22 is equal to the width of the preferred board mat 16, in the preferred case, eight feet. These mid-cross boards 22 extend side-to-side continuously from a first end 20 of base board 18 to a second end 20 of base board 18 forming thereupon a relatively smooth continuous surface.

Longitudinally across the surface formed by the mid-cross boards 22 is the board road 2 driving surface 24 which is a relatively smooth continuous surface of the desired size for the overall mat section, that is in the preferred embodiment eight by sixteen feet; surface 24 comprises a longitudinal series of a plurality of longitudianlly running closely abutted upper boards 26 each of which is tightly and firmly affixed by a combination of nails, screws, gluing or the like to the mid-cross boards 22.

In a lengthwise direction each mat 16 has a first and a second end.

The first end comprises the female end junction 28 for connecting the sequence of board mat 16 together to form a board road 2. In detail, this female end juction 28 which extends outwardly a distance beyond the outer edge of the driving surface 24, comprises an inner cross beam 30 which is firmly affixed to the first end of each of the plurality of upper boards 26 involved in the board mat, running perpendicularly thereto to the extreme sides of the board mat 16. The inner cross beam 30 is in the preferred embodiment spaced so as to be aligned with the outer ends of the upper boards 26.

Fastened at the mid point of the inner cross beam 30 extending outwardly therefrom in the same plane as the inner cross beam 30 is spacer brace 32. At a first and second side ends of the inner cross beam 30 are found two outer spacer braces 34. The two spacer braces 34 and the one spacer brace 32 are all of a uniform width; fastended to the outer ends thereof is found an outer cross beam 36, which in turn runs transversely a length equal to the width of the overall board mat 16. The combination of the inner cross beam 30, the space brace 32, the outer spacer braces 34 and the outer cross beam 36 create a pair of junction sockets 38 forming thereby upon end 28 of board mat 16 a female end junction.

At the second end of the board mat 16 is found a male end junction 40 constructed by the installation crosswise to the upper boards 26 and flush mounted to the ends thereof a pair of male junction plugs 42. These male junction plugs 42 are spaced from each other a distance equal to the width of the spacer brace 32 and are located a distance away from the sides of the board mat 16 by a distance equal to the width of the outer spacer braces 34, allowing of course for clearance to maneuver. Each of the plugs 42 is of dimension slightly smaller than the interior dimensions of the junction sockets 38. These male junction plugs 42 together with and fastened to the upper boards 26 of the first board mat 16 form a male end junction 40.

Turning to FIG. 7 in conjunction with FIGS. 3 and 6 there is shown a second board mat 52.

It can be seen that on each of the two sides of the second board mat 52 there are mounted four side male junction plugs 54. Each of these junction plugs 54 is of a size slightly smaller than the inner dimensions of the junction socket 38 heretofore described. These side male junction plugs 54 are affixed flush to the sides of the second board mat 52; the base boards 16 and midcross boards 22 of said second board mat 52 having been cutaway to provide a free area for their mounting. The stability of the mat is maintained by the use of several (five or more) 2" wide by 18" long by ½" thick metal braces where the midcross boards are cut away. Further, as can be seen, the side male junction plugs 54 are particularly spaced along the side of the second board mat 52 in the preferred embodiment, a first such side male junction point 54 is spaced a distance from a first corner of a side by the width of an outer spacer brace 34. A second male junction plug 54 is spaced along the side from the first such junction plug 54 by a distance equal to the width of a spacer brace 32. A third male junction plug 54 is spaced from the second male junction plug 54 by a distance equal to the width of two outer space brace 34, and a fourth male junction plug 54 is spaced from the third male junction plug 54 by a distance equal to the width of a spacer brace 32. As is obvious, the fourth male junction plug 54 will be spaced from a second corner formed along the same boardmat side by its abuttment to the second end of the board mat 52 by a distance equal to the width of an outer spacer brace 34. It is the requirement for this particular spacing, as will be discussed hereinafter, that establishes the ratio of 2:1 length to width for the board mat sections. While the preferred dimension is eight feet by sixteen feet, it can be seen that such board mats may be scaled up or down in size; it remains a requirement that the dimensions be an integer ratio, side length to width. In the preferred embodiment the ratio is 2:1, however, as will be obvious to anyone skilled in the art integer ratios such as 2:1, 3:1 or 4:1 are possible.

At each of the corners 43 of the board mat 16 or the board mat 52 is found a side compliant junction 44. Each such junction 44 comprises a single metal bracket 46, in the preferred embodiment an angle iron section having therein a single ring eye 48. The brackets 46 provide two functions. They serve as a base for fastening pieces 36, 34, and 30 with two 15"×½" bolts.

When the board mats are laid, as will be hereinafter described, the metal brackets 46, by means of linking means not shown such as a push pin or the like, may be linked together in a pivoting joint to provide a side compliant junction 44, linking together the sides of two side-by-side board mats 16 or 52.

Thus it is intended that the female end junctions 28 and the male end junctions 40 at the ends of two end-to-end board mats 16, provide a relatively strong weight distributing joint in the direction of travel of equipment along a board road 2. The side compliant junctions 44 provide a degree of freedom of movement between two side adjacent board mats 16 or 52 capable of giving and thus relieving stress loads that would otherwise be imposed upon the board mats 16 or board mat 52 by subsistance of the ground and the like under the weight of vehicles, and yet the joint 44 is sufficiently strong to hold adjacent board mats 16 or 52 in close side-by-side relationship preventing the board mats from shifting laterally under the load imposed by traffic on a board road 2 composed of the board mats 16 or 52.

In operation, referring to FIGS. 6 and 7 as details of FIGS. 1 and 2, the board mats are transported along the existing highway 4 to the point where the board road 2 is to be constructed. The individual board mats 16 or 52 as required are then in sequence lifted from the transportation means by a crane or the like, not shown, and lowered sequentially into position. A first row of board mats is aligned side-by-side to form the turn off junction 6, or later in sequence, the road paths 8 or the turn junctions 10 as required. Bracket linking means not shown such as push pins are connected between adjacent metal brackets 46 at the corners of the board mats 16 or 52 to create a side compliant junction 44 holding an array of first row of board mats 56 in position. The orientation of each of these board mats is such that the male end junction 40 is toward the existing road bed or towards the already existing board mats, and the female ends junction 28 is in the direction the board mats are being laid, or in the direction of the creation of the road 2.

Referring specifically to FIG. 6, a second board mat 16 is then laid to start a second row 58 by placing the male end junction 40 of the second board mat 16 connecting into the already laid female end junction 28 of the first board mat 16 in the first row, by lowering the board mat so that the male junction plugs 42 are inserted into and fit within the junction socket 38. A side-to-side sequence of board mat 16 is thus laid forming a second row 58. The metal brackets 46 are connected by the bracket linking means as heretofore described to form a side-by-side junction. The process is then repeated for each of the successive rows.

When approaching a turn junction 10, the board mats 52 are used to end a road of the board mats 16 as will be seen from the description. A pair of board mats 16 in a first road path 8 presents at the far end in the sequence of laying a road 2, a set of four aligned junction sockets 38 of a spacing determined by the combination of the widths of the spacer braces 32 and outer spacer bracers 34 in a specific pattern that is obvious from the previously provided description and which matches the spacing of the side male junction plugs 54 previously described along a side of a second board mat 52. The first road path 8 is therefore terminated and the direction of the board row 2 turned 90° by installing a second board mat 52 perpendicularlly to the direction of the first row path 8 so that the four side male junction plugs 54 fit into and lock into the four junction sockets 38 in the same manner that the male junction plugs 42 would normally lock into the junction sockets 38. The second board mat 52 having thus changed the direction of travel of the road path 8 to a second road path 12. The road path 12 is continued by installation of first board mat 16 as heretofore described.

Thus it can be seen that a sequence of turns and straights can be readily assembled out of the two sections of board mats 16 or board mat 52. The particular sequence of female and male ends 28 and 40 is determined primarily by the convenience of operation in that the equipment and personnel laying the board road will be standing upon and holding down the already laid sections of board mats 16, and thus it is most convenient for ease of operation that the exposed junction ends be female junction ends 28 and the next section of board mats be vertically lowered therein as male end junctions 40.

The resulting board road 2 has certain advantages over the prior art board roads in that the individual sections 16 float as units upon the unprepared subsurface soil and there is significantly less stress placed upon unsecured underplanks and significantly less risk of major sections of the road sinking into the soil to create a totally uneven or weakened road bed structure.

As is obvious, upon completion of work requiring use of the board road, the process of assembly can be readily reversed and a small crew with the appropriate crane and equipment can disassemble the board road in the reverse sequence from which it was assembled, pulling each mat section 16, 52 in turn for transportation to a new site.

In addition, the floating nature of the particular boards in the board mats does not require an impervious underlayer or under-fabric to prevent sinking of individual boards into the underlying soil. Therefore it is considered preferable that the boards be laid on a porous fabric surface such as a filter fabric. In turn this fabric is not driven into the soil as was true for the prior art, Visquene TM or polyethylene films, and much of the fabric is also recoverable and reusable.

Because this under-fabric is porous, since it is not required to provide floatation, it provides ready drainage of any entrapped water, and thus significantly reduces the probably of rot occurring within the individual board mat sections 16 or 52.

As can be seen this system is readily scaleable in size to any desired board mat sizes. The individual end junctions provide significant strength for supporting the heaviest machinery and equipment and the side compliant junctions in combination therewith provide a degree of flexibility preventing cracking or splintering under the board mat under combinations of heavy traffic loads and shifting, sinking or unstable soil underburdens or supports. The combination therefore provides a method for creating board roads that is significantly easier and quicker for installation than heretofore possible, and at the same time significantly more conservative of material costs and losses in that the components are not consumable but rather are now more reusable.

It can thus be seen to those skilled in the art of board roads that the instance invention comprises not just the specific sizes and configuration named but similarly scaled and proportioned sizes and configurations of mat sections for building board roads and the like.

I claim:

1. A temporary road comprising a plurality of mat sections, each section comprising:

a first bottom or lower layer made of substantially parallel runner members;

a second intermediate layer made of substantially parallel runner members attached in transverse relationship to the first layer runners;

a third, top or upper layer made of substantially parallel runner members attached in transverse relationship to the intermediate layer runners;

a first fastening means attached transversely to one end of the upper layer perpendicularly to the road; and a second fastening means attached to the opposite end of the upper layer and adapted to receive in vertical relationship a respective first fastening means of a subsequent mat section.

2. The apparatus of claim 1, wherein each mat section further comprises corner attachment means for connecting the mat section to an adjacent mat section in side-by-side relationship.

3. A temporary road comprising a plurality of mat sections, each section comprising:

a first bottom or lower layer made of substantially parallel runner members;

a second intermediate layer made of substantially parallel runner members attached in transverse relationship to the first layer runners;

a third, top or upper layer made of substantially parallel runner members attached in transverse relationship to the intermediate layer runners;

a first fastening means attached to one end of the upper layer, wherein the first fastening means comprises at least one longitudinal plug transversely attached to the bottom of the upper layer; and a second fastening means attached to the opposite end of the upper layer and adapted to engage with a respective first fastening means of a subsequent mat section.

4. A temporary road comprising a plurality of mat sections, each section comprising:

a first bottom or lower layer made of substantially parallel runner members;

a second intermediate layer made of substantially parallel runner members attached in transverse relationship to the first layer runners;

a third, top or upper layer made of substantially parallel runner members attached in transverse relationship to the intermediate layer runners;

a first fastening means attached to one end of the upper layer; and a second fastening means attached to the opposite end of the upper layer and adapted to engage with a respective first fastening means of a subsequent mat section, wherein the second fastening means comprises a longitudinal spacer brace means transversely attached to the bottom of the upper layer, said spacer brace means being provided with a recess adapted to receive in engaging relationship the first fastening means of the subsequent mat section.

5. The apparatus of claim 3, wherein the longitudinal plug extends downwardly to at least the height of the intermediate layer.

6. The apparatus of claim 3, wherein the plug is attached to the end of the upper layer at a distance laterally from the ends of the intermediate and lower layers.

7. The apparatus of claim 3, wherein the plug extends downwardly to the height of the intermediate and lower layers.

8. The apparatus of claim 4, wherein the spacer brace means comprises at least one longitudinal runner member extending downwardly to the height of at least the intermediate layer.

9. The apparatus of claim 4, wherein the spacer brace means comprises at least one longitudinal runner member extending downwardly to the height of the intermediate and lower layers.

10. The apparatus of claim 1, further comprising means for connecting adjacent mat section in side-by-side relationship at the change of direction of the road.

11. The apparatus of claim 10, wherein the means for connecting adjacent mat sections comprise a plurality of lateral plugs attached in spaced relationship to one side of the mat section perpendicularly to the road and spacer brace means attached to the opposite side of the mat and adapted to receive in engaging relationship the lateral plugs of the adjacent mat section.

12. The apparatus of claim 11, wherein each plug extends downwardly from the upper layer to at least the height of the intermediate layer.

13. The apparatus of claim 11, wherein each plug extends downwardly from the upper layer to the height of the intermediate and lower layers.

14. The apparatus of claim 11, wherein the space brace means comprises laterally extending runner members and having a number of recesses to engagingly receive the plugs of the adjacent mat section.

15. The apparatus of claim 11, wherein the spacer brace means comprises runner members attached to the upper layer and extending downwardly to at least the height of the intermediate layer.

* * * * *